US005787811A

United States Patent [19]

Achelpohl et al.

[11] Patent Number: 5,787,811

[45] Date of Patent: Aug. 4, 1998

[54] FLEXOGRAPHIC PRINTING PRESS

[75] Inventors: Fritz Achelpohl; Günter Rogge, both of Lienen, Germany

[73] Assignee: Windmöller & Hölscher, Lengerich/Westf., Germany

[21] Appl. No.: 819,315

[22] Filed: Mar. 18, 1997

[30] Foreign Application Priority Data

Mar. 20, 1996 [DE] Germany ..... 196 11 048.3

[51] Int. Cl.[6] ..... B41F 31/32

[52] U.S. Cl. ..... 101/349.1; 101/350.1; 101/350.4

[58] Field of Search ..... 101/349.1, 350.1, 101/350.4, 351.1, 363

[56] References Cited

U.S. PATENT DOCUMENTS

| | | | |
|---|---|---|---|
| 4,602,562 | 7/1986 | Ottenhues et al. | 101/182 |
| 5,083,511 | 1/1992 | Hertel et al. | 101/174 |

FOREIGN PATENT DOCUMENTS

| | | |
|---|---|---|
| 325445 | 7/1989 | European Pat. Off. . |
| 0615841B1 | 5/1996 | European Pat. Off. . |
| 19516223A1 | 11/1996 | Germany . |
| 19516224A1 | 11/1996 | Germany . |
| 2143474 | 2/1985 | United Kingdom . |
| 2146291 | 4/1985 | United Kingdom . |
| 2281534 | 3/1995 | United Kingdom . |

*Primary Examiner*—Edgar S. Burr
*Assistant Examiner*—Daniel J. Colilla
*Attorney, Agent, or Firm*—Evenson, McKeown, Edwards & Lenahan, PLLC

[57] ABSTRACT

A printing press includes a central impression drum seated in bearings in a printing press frame. The drum is provided with a drive. At least one printing unit has a driven printing cylinder, which can be pressed against the central impression drum, and an inking roller, which can be pressed against the printing cylinder and which operates in combination with a cleaning inking system. The central impression drum, the printing cylinder and the inking roller have gears on their axles for driving them. The anilox roller is provided with a special continuous running drive. The printing cylinder gear can be coupled with the central impression drum and the anilox roller gear can be coupled with the printing cylinder gear by parallel displacement of the printing cylinder and anilox roller, respectively. The inking roller is driven both for continued running at a continuous-run rotational speed which is lower than the operational rotational speed and for cleaning the doctor blade assembly in a reversed direction at a rotational speed which is higher than the operational rotational speed. In order to drive the inking roller in this way, it can be coupled by a first shiftable clutch to the inking roller gear and by a second shiftable clutch to a variable-speed and reversible inking roller drive.

4 Claims, 5 Drawing Sheets

FLEXOGRAPHIC PRINTING PRESS

BACKGROUND OF THE INVENTION

1. Field of the Invention

This invention relates to a printing press, preferably a flexographic printing press, having a central impression drum seated in bearings in a printing press frame and provided with a drive. At least one printing unit includes a driven printing cylinder which can be pressed against the central impression drum. An inking or anilox roller can be pressed against the printing cylinder and operates in combination with a cleaning inking system. The central impression drum, the printing rollers and the anilox rollers each have gears on their axles by which they are driven. The anilox roller is provided with a special continuous running drive. The printing cylinder gear can be coupled with the central impression drum gear and the anilox roller gear can be coupled with the printing cylinder gear by parallel displacement of the printing cylinder and the anilox roller, respectively.

2. Description of Related Art

A flexographic printing press of this type is known, for example, from DE-PS 34 37 216. A drive for the central impression drum and a drive for the printing cylinder and the anilox roller of only one printing unit of the known printing press are shown in FIG. 7 of the drawings and are briefly described in the following.

The shaft journals of the central impression drum 3, indicated only by the dashed center line, are seated in bearings in the side parts 1 and 2 of the printing press frame. The bull gear 4 is held by a key on the right shaft journal of the central impression drum 3. The bull gear 4 is driven by the main drive motor 5, which is an electric motor, via the drive pinion 6 and the intermediate gears 7, 8, 9 and 10, which form a corresponding gear stage. The gears 8 and 9 are held by keys on a shaft 11, indicated by a dashed line, which is also seated in bearings in the printing press frame.

The printing cylinder 12 and the anilox roller 13 are seated in bearings in the bearing blocks of slide carriages which can be movably guided on brackets of the printing press frame. Such a construction is described in DE-PS 34 37 216. The printing cylinder gear 14 and the anilox roller gear 15 are set on the right shaft journals extending through the bearing blocks of the printing cylinder 12 and the anilox roller 13, also shown only by dashed lines, so that the anilox roller gear 15 is seated in bearings on the anilox roller shaft journal via a clutch 16. By moving the printing cylinder slide carriage and the anilox roller slide carriage, the gear teeth of the bull gear 4 and the printing cylinder gear 14, as well as of the printing cylinder gear 14 and the anilox roller gear 15, can be brought into and out of engagement. In this way, the printing cylinder and anilox roller slide carriages can carry out both a large-travel movement for replacement of a printing cylinder and a short-travel movement for moving into a "print-off position". In the print-off position, the drum and cylinders are safely moved apart but still have their gear teeth loosely engaged with each other.

Usually, the anilox roller 13 continues to run in the print-off position at a lower rotational speed than during the printing operation in order to prevent the printing ink from drying up during relatively short printing interruptions. A drive providing this continuous run includes the servomotor 17. The servomotor 17 drives the anilox roller 13, at the left shaft journal, via the gear stage consisting of the gears 18 and 19 and the clutch 20. This continuous-run drive is possible because the anilox roller 13 can be turned in one direction due to the right clutch 16 even when the anilox roller gear 15 is stopped. The continuous-run drive does not prevent driving of the anilox roller 13 via the bull gear 4 and the printing cylinder gear 14 during normal printing operation because the drive gear 19 is also seated in bearings via a clutch 20 on the left shaft journal of the anilox roller 13.

A cleaning inking system, as is explained further in German Patent Application No. 195 48 535.1 dated Dec. 22, 1995, is pressed against the anilox roller 13.

This cleaning inking system is discussed briefly below and is illustrated in FIG. 8. The system includes a doctor blade bracket 21, having a profile shaping rail, which can be adjusted on the anilox roller 13. The rail of the doctor blade bracket 21 is provided with a groove which forms an inside space of the ink chamber. A bored hole 22 which supplies the printing ink opens into this groove in its center area. Bored holes 23 and 24, which carry off the printing ink, are located in the lower end areas of the groove. The front sides of the groove edges of the doctor blade bracket are slanted away in opposite directions in a rooflike formation. On these front sides, doctor blades are attached. The doctor blades can make trimming, rubbing or both trimming and rubbing contact with the anilox roller 13. Seals are arranged on the sides of the doctor blade bracket and seal off the inside space of the ink chamber opposite the anilox roller 13. Doctor blade assemblies of this sort are known, for example, from German Patent Application Nos. 195 16 223.3 and 195 16 224.2. Reference can be made to these publications for a more precise description of the doctor blade assembly.

In the doctor blade assembly known from German Patent Application No. 195 48 535.1, the anilox roller is driven one or more times in an opposite direction during rinsing for purposes of cleaning the doctor blade assembly. The anilox roller is driven in this manner at a high rotational speed, i.e. at a rotational speed which lies above a rotational speed used during the printing operation.

SUMMARY OF THE INVENTION

The problem addressed by this invention is the creation of a printing press of the type mentioned previously in which the anilox roller can be driven for continued running at a continuous-run rotational speed lower than the operational rotational speed and yet be driven for cleaning the doctor blade assembly at an increased rotational speed, as opposed to the operational rotational speed, in the reversed direction.

This problem is solved, according to the invention, by coupling the anilox roller to the anilox roller gear via a shiftable clutch. The anilox roller can be coupled by a second shiftable clutch to a variable-speed and reversible anilox roller drive. The anilox roller gear is connected to the shaft journal of the anilox roller by a shiftable clutch rather than by a free-wheel. Consequently, the anilox roller can be driven independently of the printing press drive and, while the printing press is standing still, via the anilox roller drive in both rotational directions at any particular rotational speed. The anilox roller, therefore, is driven at both the lower continuous-run rotational speed and also at the higher rotational speed for cleaning.

In DE-PS 34 37 216, it is noted that aligning the printing cylinders in proper registration with each other after replacement is a special problem for printing presses, especially flexographic printing presses. A further object of the invention, therefore, is to create a flexographic printing press in which a simple and proper registration alignment of the printing cylinders is possible after their replacement.

According to the invention, this is achieved by having the printing cylinder gear only be coupled to the central impression drum gear by a parallel displacement. The anilox roller is provided with a separately controllable, variable-speed and reversible drive and can be coupled to the printing cylinder gear by a gear.

The printing cylinders are only driven during the printing operation by the bull gear with which the printing cylinder gears engage. The anilox roller is also driven via the anilox roller drive in the printing operation such that the rotational speed of the anilox roller can be controlled by a computer. In order to make a simple and precise control of the rotational speed possible, the drive motor for the anilox roller drive is formed by a stepper motor.

During a printing operation, therefore, the anilox roller can be driven at the same circumferential speed as the printing cylinder. Furthermore, it is also possible, during the printing operation, to drive the anilox roller at a higher or lower circumferential speed than that of the printing cylinder so that inking of the printing cylinder can be controlled.

During a "print-off" operation, in which the anilox roller does not contact the printing cylinder, the anilox roller can be driven at the desired lower continuous-run rotational speed.

During a cleaning operation, the anilox roller can be driven in a reversed direction and at a higher rotational speed than during the printing operation.

A special advantage of the invention is that the anilox roller drive can be used, after replacement of the printing cylinders, in order to align the printing cylinders of several printing units so that they are in proper registration. For this purpose, the printing cylinder gears are provided with a mark, such as an identifying hole, by which the printing cylinder can be rotated into an initial position opposite the printing press frame. Starting from this initial position, the anilox roller drives rotate the individual printing cylinders into positions in which they are aligned in proper registration. In this process, control of the individual stepper motors of the anilox roller drives is done by a computer. Initial positions and individual turning angles for aligning the printing cylinders in their proper registration positions are stored in the computer.

Based on computer performance, it is also possible to carry out the required adjustments while the printing press is running and, after aligning the individual printing cylinder gears so that they are in proper registration, to bring them into the proper angles and into precise engagement with the gear teeth of the bull gear.

For proper registration adjustment of the individual printing cylinders, the printing cylinder gears, or both the individual printing cylinders and the printing cylinder gears, a printing cylinder gear is brought into engaged coupling with an anilox roller gear. The coupling and uncoupling of the anilox roller gear with the printing cylinder gear is performed by the axial displacement of one of these gears. The computer makes certain that a proper engagement angle of the gears occurs and that teeth do not knock against one another.

The anilox roller may be provided with a separately controllable, variable-speed and reversible drive. The printing cylinder gear can be coupled to only the anilox roller gear, and the anilox roller gear can be detached from the anilox roller by a shiftable clutch.

In this construction, the printing cylinder is no longer driven by the bull gear which drives the central impression drum in the printing operation. The printing cylinder is instead driven via the anilox roller drive. All advantages of the printing press can be obtained by this construction. In addition, while a printing operation is performed by the printing cylinder, a speed which deviates from the circumferential speed of the central impression drum can be imparted by the anilox roller drive. Consequently, based on the relative speed obtained, unwinding errors of the web to be printed can be offset. A slower rotation of the printing cylinder can be used to extend the print image in the circumferential direction. A higher rotational speed can be used to flatten the print image.

DESCRIPTION OF THE PREFERRED EMBODIMENTS

Figure 2:
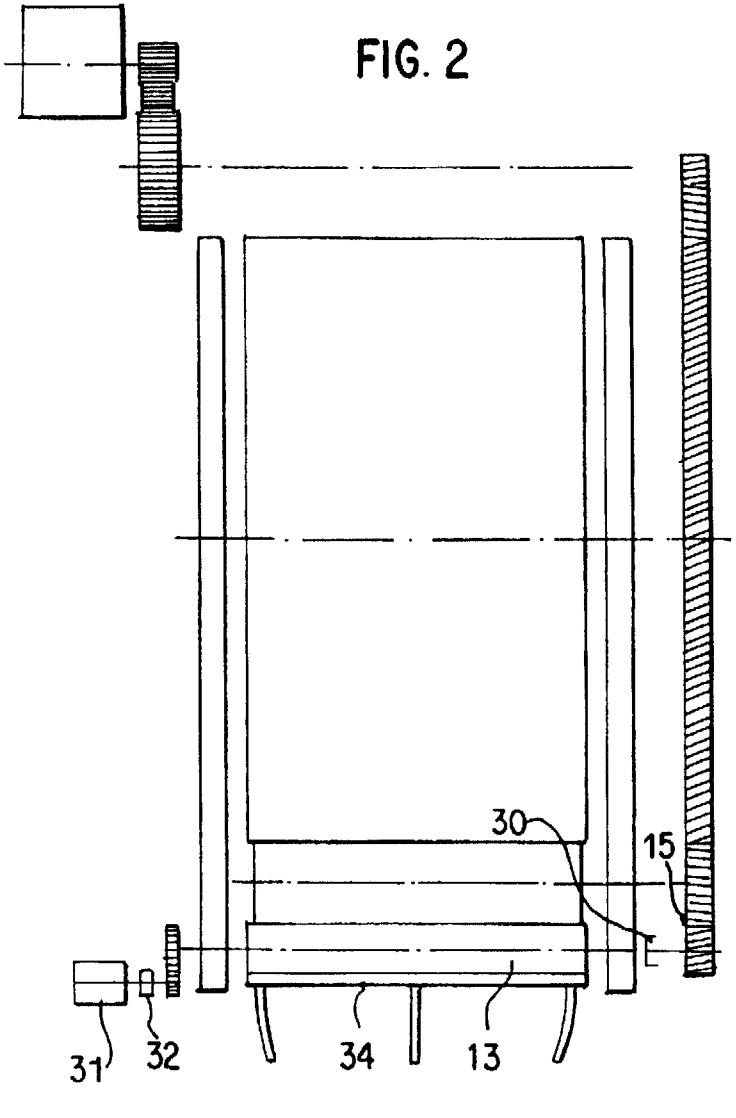
FIG. 2 is a view corresponding to FIG. 1 in which the printing cylinder and the anilox roller are in a print-on position.
Figure 1:
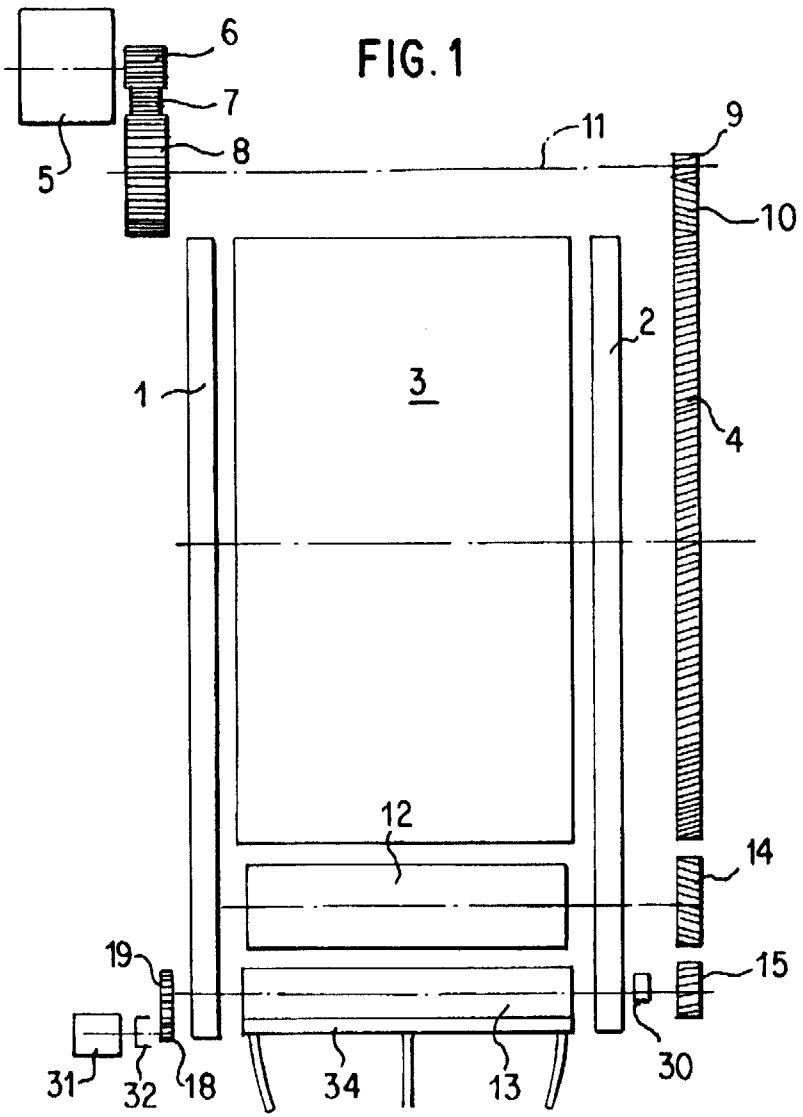
FIG. 1 is a view of the drive of a central impression drum, a printing cylinder and an anilox roller of one of several printing units of a flexographic printing press according to a first embodiment of the invention.

FIGS. 1 and 2 show the drive of the central impression cylinder and the printing cylinder as well as the anilox roller of one of several printing units of a flexographic printing press according to the first embodiment of the invention.

The same reference numbers are used throughout FIGS. 1 to 7 to indicate the same parts of the various flexographic printing press configurations illustrated.

Figure 7:
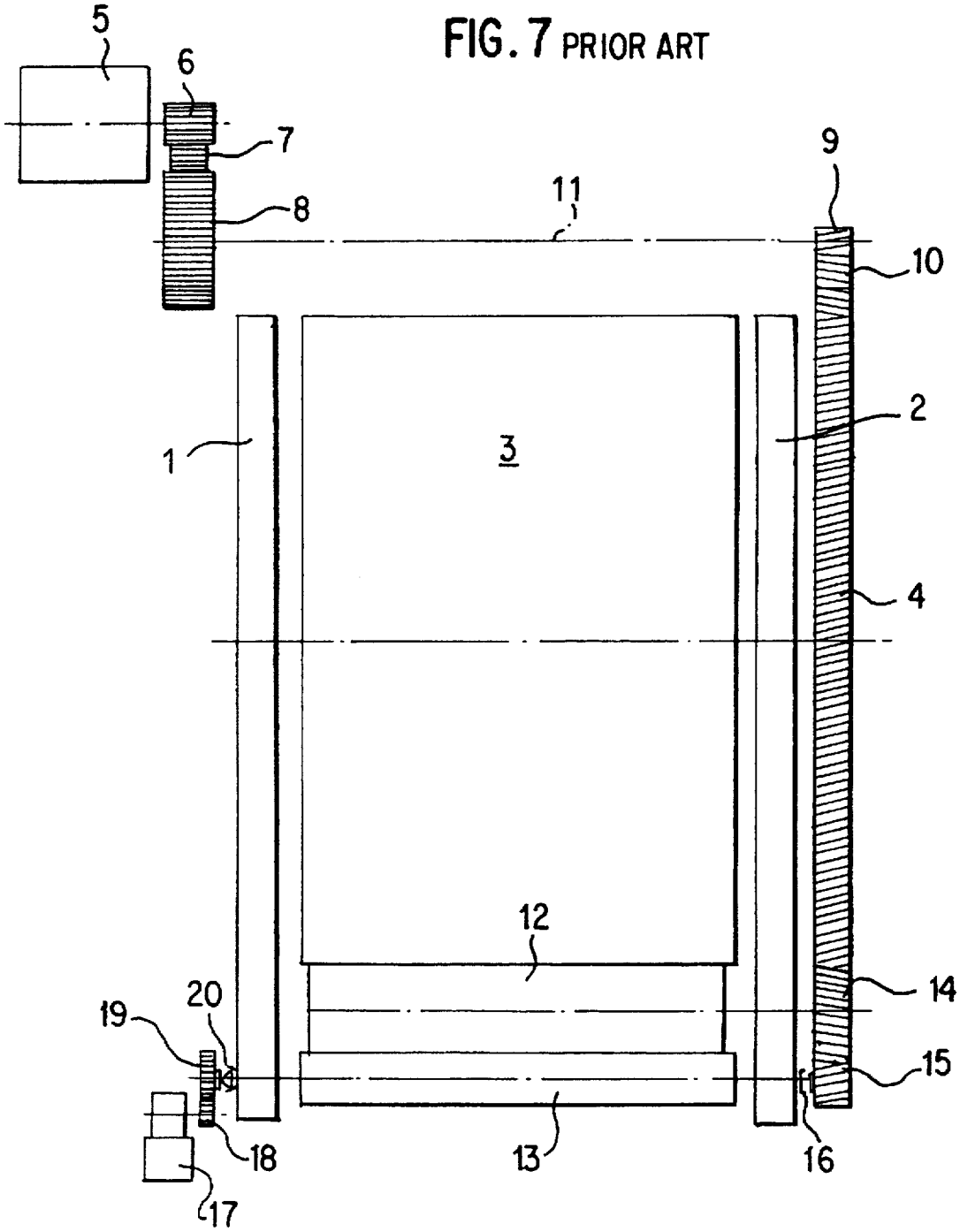
FIG. 7 PRIOR ART
FIG. 7 is a representation of a known drive.
Figure 8:
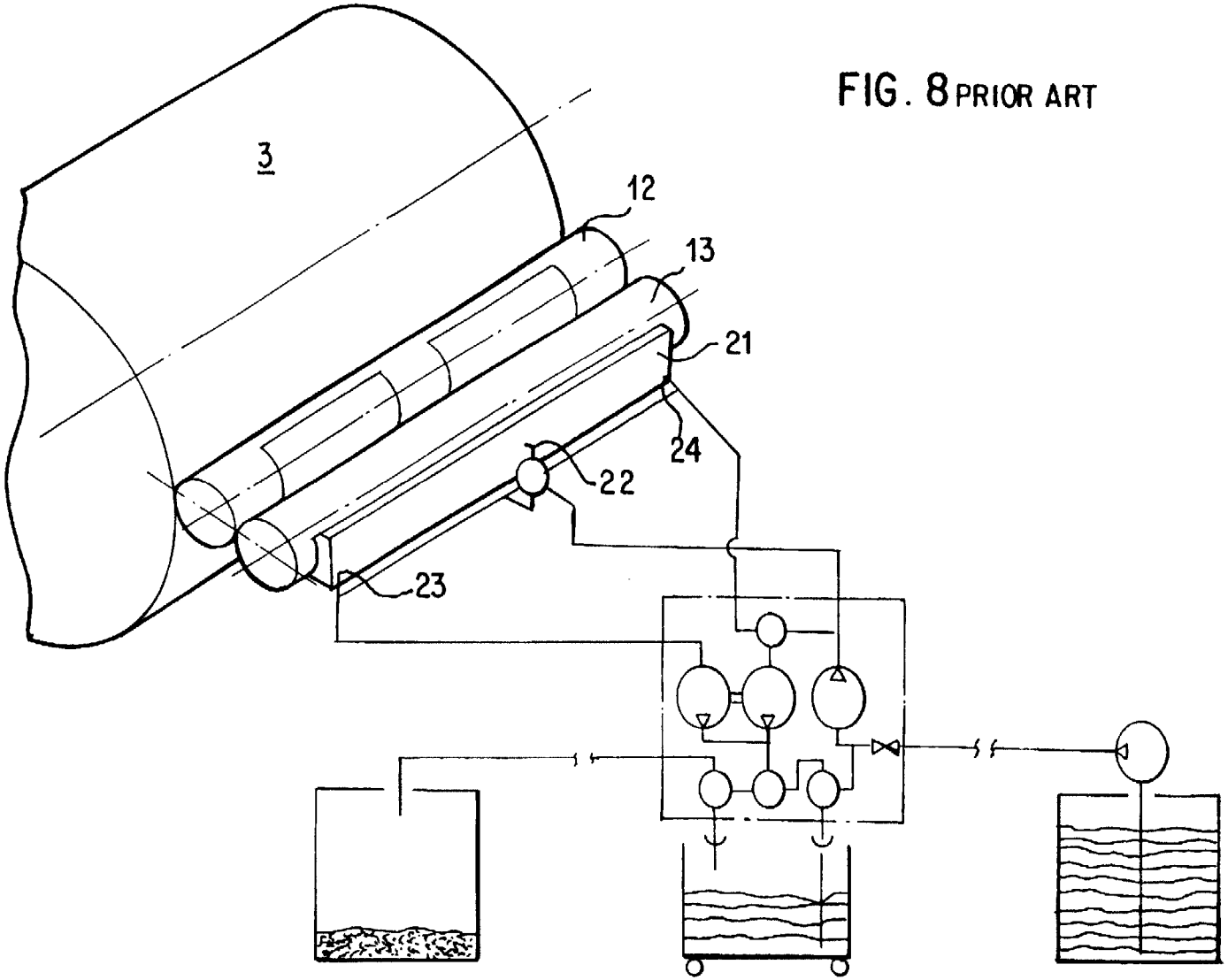
FIG. 8 PRIOR ART
FIG. 8 is a schematic perspective representation of a central impression drum, a printing cylinder, an anilox roller, and a cleaning inking system.

The drive according to FIGS. 1 and 2 is distinguished from the known drive shown in FIG. 7 in that the anilox roller gear 15 can be connected to the right shaft journal of the anilox roller 13 by a shiftable clutch 30. The motor 31 can be connected to the pinion gear 18 of the gear stage 18 and 19 by a second shiftable clutch 32. Furthermore, a cleaning inking system 34 can be set on the anilox roller 13. This system has been described in conjunction with FIG. 8.

In FIG. 1, the drive is depicted in a position in which the slide carriages holding the printing cylinder 12 and the anilox roller 13 have been carried away by long-travel movements far enough from the central impression drum 3 that the printing cylinder gear 14 no longer engages with the bull gear 4 and the anilox roller gear 15 no longer engages with the printing cylinder gear 14. In this condition, the printing cylinder 12 can be lifted out for replacement. In the position depicted, the anilox roller 13 can be driven in reverse via the motor 31 during a washing or cleaning operation while the main drive is standing still. The anilox roller can be driven at a rotational speed which is higher than the rotational speed used during the printing operation. For this purpose, the shiftable clutch 32 is engaged by the central printing press control so that the motor 31, which runs in both rotational directions, drives the anilox roller 13, via the gear stage formed by gears 18 and 19, at the desired rotational speed in the desired rotational direction.

Even if the gears 4, 14 and 15 are loosely engaged in the print-off position, the anilox roller 13 is driven at a lower continuous-run rotational speed while the main drive is standing still and a higher rotational speed during the cleaning operation. This is because the anilox roller 13 is uncoupled from the anilox roller gear 15 by the first shiftable clutch 30 in the print-off condition.

During a printing operation, the anilox roller gear 15 is coupled with the anilox roller 13 by engagement of the clutch 30. The motor 31 is uncoupled by the release of the clutch 32, which could also be arranged at another position. The status of the drive during the printing operation can be seen from FIG. 2.

The motor 31 can be controlled by a central machine control, for example a computer, and made stronger as the requirements being placed on it become higher.

Figure 3:
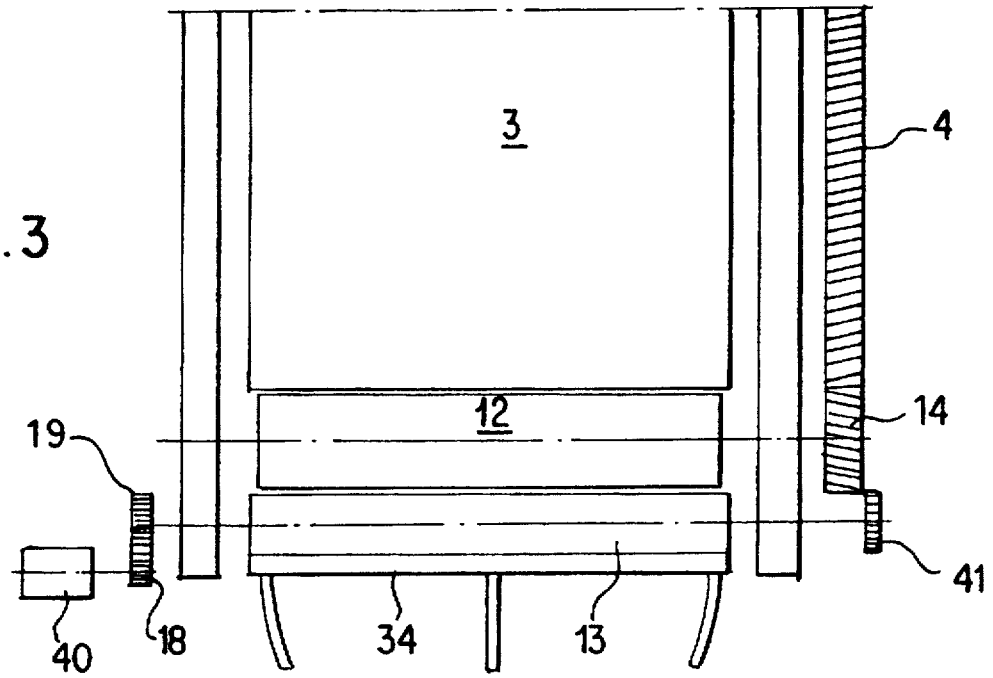
FIG. 3 shows a second embodiment of the drive in which the printing cylinder and anilox roller are located in the print-off position.
Figure 4:
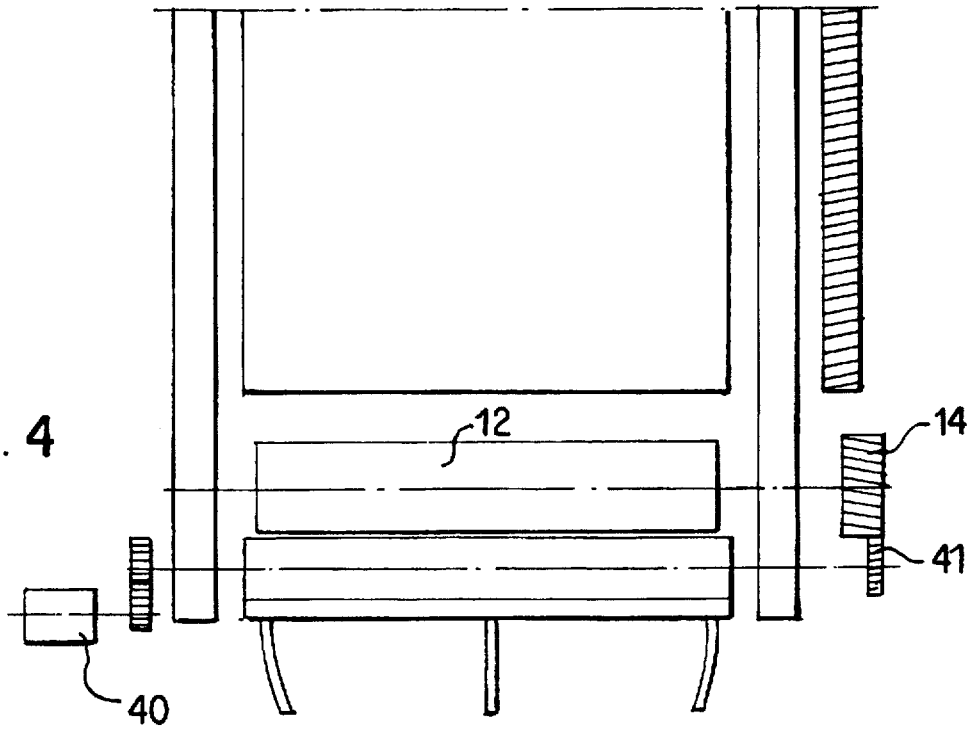
FIG. 4 is a view corresponding to FIG. 3 in which the printing cylinder gear has been brought out of engagement with the gear teeth of the bull gear and into engagement with the gear teeth of the anilox roller gear.

In the second embodiment of the drive shown in FIGS. 3 and 4, only the printing cylinder gear 14 can be brought into engagement with the teeth of the bull gear 4 by parallel displacement of the slide carriage holding the printing cylinder 12. The anilox roller 13 is driven exclusively by the servomotor 40 via the gear stage formed by gears 18 and 19 both during the printing operation and during the continuous-run and cleaning operations.

The right shaft journal of the anilox roller 13 is provided with a gear 41 which can be brought into engagement with the teeth of the gear 14 only by axial displacement after uncoupling the gears 4 and 14 and the corresponding concurrent movement and/or alignment of the printing cylinder 12 and the anilox roller 13. The printing cylinder 12 can be aligned with the printing cylinders of other printing units via the anilox roller drive for presetting the registration after replacement.

Prior to start-up of the printing operation, the printing cylinder gear 14 is again brought out of engagement with the gear 41 of the anilox roller by axial displacement. The printing cylinder is advanced into its printing position on the central impression drum 3 so that the gear teeth 4 and 14 come into engagement in the proper way for the bearings.

Figure 6:
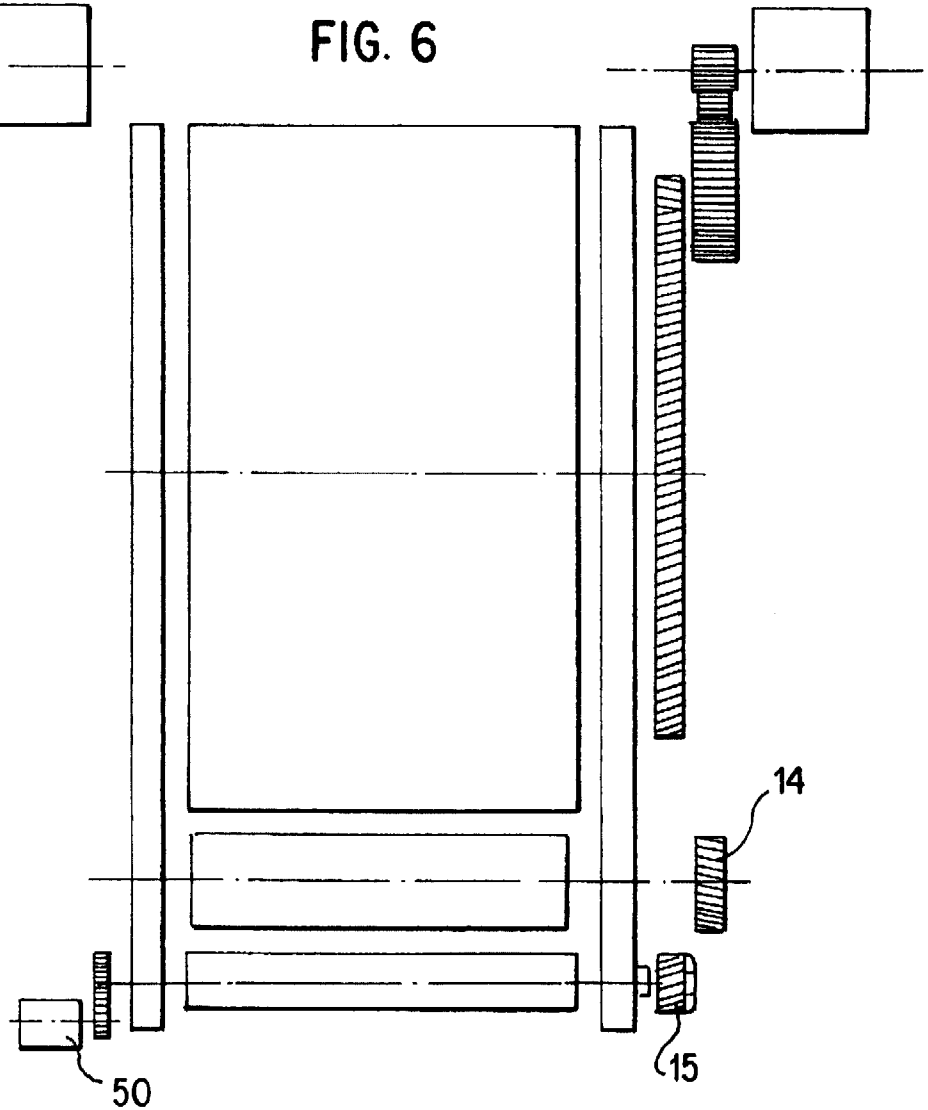
FIG. 6 is a view corresponding to FIG. 5 in which the printing cylinder and anilox roller have been carried away from the central impression cylinder by long-travel movements.
Figure 5:
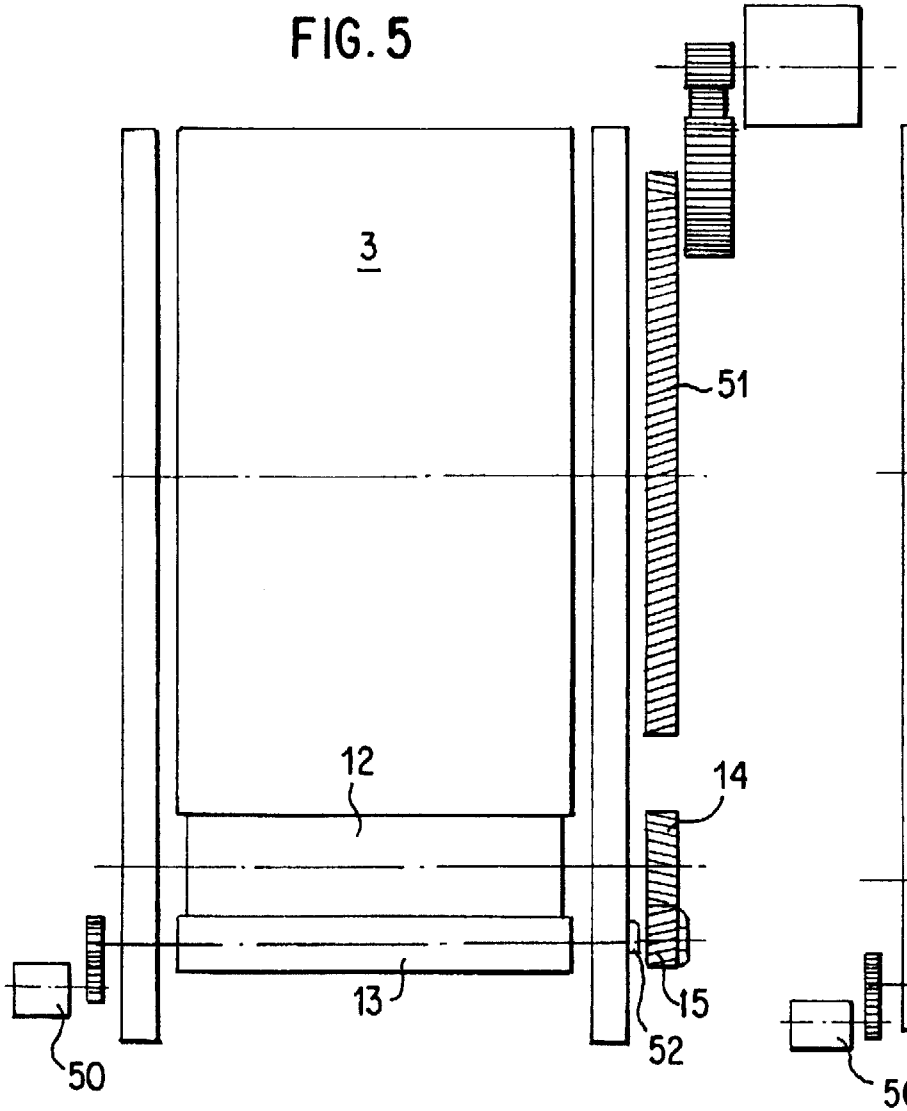
FIG. 5 is a view of a third embodiment of the drive in which the printing cylinder and anilox roller are located in the print-on position.

The third embodiment of the drive according to the invention, shown in FIGS. 5 and 6, is distinguished from the embodiment shown in FIGS. 3 and 4 in that, even during the printing operation, the printing cylinder 12 is driven by the servomotor 50 for driving the anilox roller 13. The bull gear 51 is thus designed with a correspondingly smaller diameter so that it no longer comes into engagement with the printing cylinder gear 14 in the printing operation.

In order to be able to drive the anilox roller 13 independently of the printing cylinder 12 in a continuous-run operation and in a cleaning operation, the anilox roller gear 15 can be uncoupled by a shiftable clutch 52 of the anilox roller gear 15.

Furthermore, as can be seen from FIG. 6, the printing cylinder gear 14 can be brought into and out of engagement with the anilox roller gear 15 by corresponding axial displacement on a spline shaft journal. This operation is necessary during pre-setting in order to bring all printing cylinders into their initial positions in which they are aligned in their rotational angles to the machine frame based on identification marks.

The servomotors for the anilox roller drives are selected such that they have suitable power for the demands placed on them and so that they can be controlled by the machine control for adjusting the printing cylinders according to their angles.

The invention has been described above only in connection with one printing unit of a flexographic printing press. However, it applies correspondingly to the additional printing units in multicolor printing presses.

We claim:

1. A flexographic printing press comprising:

a printing press frame, a central impression drum seated in bearings in the printing press frame, a drive for said central impression drum, at least one printing unit including a driven printing cylinder which can be pressed against the central impression drum and an anilox roller which can be pressed against the driven printing cylinder, a cleaning inking system with which said anilox roller operates in combination, gears on axles of the central impression drum, the driven printing cylinder and the anilox roller for driving them, and a continuous running, variable speed and reversible anilox roller drive with which said anilox roller is provided, wherein the driven printing cylinder gear can be coupled with the central impression drum gear, the anilox roller gear can be coupled with the driven printing cylinder gear by parallel displacement of the printing cylinder and the anilox roller, respectively, the anilox roller can be coupled to the anilox roller gear via a first shiftable clutch, and the anilox roller can be coupled by a second shiftable clutch to said variable speed and reversible anilox roller drive.

2. A flexographic printing press comprising:

a printing press frame, a central impression drum seated in bearings in the printing press frame, a drive for said central impression drum, several printing units, each of which includes a driven printing cylinder which can be pressed against the central impression drum and an anilox roller which can be pressed against the driven printing cylinder, a cleaning inking system with which said anilox roller operates in combination, gears on axles of the central impression drum, the driven printing cylinder and the anilox roller for driving them, and a separately controllable, continuous running, variable speed and reversible anilox roller drive with which said anilox roller is provided, wherein only the printing cylinder gear can be coupled with the central impression drum gear by parallel displacement and the anilox roller can be coupled by a gear to the driven printing cylinder gear.

3. A printing press according to claim 2, wherein coupling and uncoupling of the anilox roller gear with the driven printing cylinder gear is done by axial displacement of one of the anilox roller and driven printing cylinder.

4. A printing press according to claim 2, wherein the driven printing cylinder gear can only be coupled with the anilox roller gear and the anilox roller gear can be detached from the anilox roller by a shiftable clutch.

* * * * *